US008720613B2

(12) United States Patent
Carlsson et al.

(10) Patent No.: US 8,720,613 B2
(45) Date of Patent: May 13, 2014

(54) DRILL BIT FOR A ROCK DRILLING TOOL WITH INCREASED TOUGHNESS AND METHOD FOR INCREASING THE TOUGHNESS OF SUCH DRILL BITS

(75) Inventors: Jimmy Carlsson, Fagersta (SE); Göran Stenberg, Fagersta (SE); Mattias Rehnström, Fagersta (SE)

(73) Assignee: Atlas Copco Secoroc AB, Fagersta (SE)

( * ) Notice: Subject to any disclaimer, the term of this patent is extended or adjusted under 35 U.S.C. 154(b) by 610 days.

(21) Appl. No.: 12/736,135

(22) PCT Filed: Feb. 27, 2009

(86) PCT No.: PCT/SE2009/050219

§ 371 (c)(1),
(2), (4) Date: Sep. 13, 2010

(87) PCT Pub. No.: WO2009/123543

PCT Pub. Date: Oct. 8, 2009

(65) Prior Publication Data

US 2011/0000717 A1 Jan. 6, 2011

(30) Foreign Application Priority Data

Mar. 31, 2008 (SE) ..... 0800721

(51) Int. Cl.
*E21B 10/36* (2006.01)

(52) U.S. Cl.
USPC ..... 175/426

(58) Field of Classification Search
USPC ..... 175/426
See application file for complete search history.

(56) References Cited

U.S. PATENT DOCUMENTS

| | | | | |
|---|---|---|---|---|
| 4,869,329 | A | 9/1989 | Kar et al. | |
| 4,950,340 | A * | 8/1990 | Wakita et al. | 148/402 |
| 6,227,318 | B1 | 5/2001 | Siracki | |
| 6,290,008 | B1 | 9/2001 | Portwood et al. | |
| 7,258,833 | B2 | 8/2007 | Rainey et al. | |
| 2004/0009088 | A1 * | 1/2004 | Glatzle et al. | 419/14 |
| 2005/0276717 | A1 * | 12/2005 | Fang | 419/14 |

FOREIGN PATENT DOCUMENTS

| | | |
|---|---|---|
| CN | 1 500 023 | 5/2004 |
| CN | 1 890 393 | 1/2007 |
| GB | 2345503 A | 7/2000 |
| GB | 2 372 276 | 8/2002 |

* cited by examiner

*Primary Examiner* — Shane Bomar
*Assistant Examiner* — Kipp Wallace
(74) *Attorney, Agent, or Firm* — Mark P. Stone

(57) ABSTRACT

Drill bit (10) for a rock drilling tool (12), which drill bit (10) has a drilling surface (10*b*) that contacts rock during drilling. A longitudinal cross section (10*t*) of the drill bit (10) through the drilling surface (10*b*) exhibits the following relationships of Ltot(depth)/Ltot(5.0) and H(depth)/H(5.0) at the specied depths, where H(depth)/H(5.0) is measured according to a Vickers test and Ltot(depth)/Ltot(5.0) is measured according to the Palmqvist method, described in this document substantially along the drill bit's longitudinal axial center line (C): (table (I)). If the drill bit (10) has en length (L) of 10 mm or greater, and a longitudinal cross section (10*t*) of the drill bit (10) through the drilling surface (10*b*) exhibits the following relationships of Ltot(depth)/Ltot(3.5) and H(depth)/H(3.5) at the specified depths, where H(depth)/H(3.5) is measured according to a Vickers test and Ltot(depth)/Ltot(3.5) is measured according to the Palmqvist method described in this document, substantially along the drill bit's longitudinal axial center line (C): (table (II)). If the drill bit (10) has en length (L) less than 10 mm.

15 Claims, 6 Drawing Sheets

DRILL BIT FOR A ROCK DRILLING TOOL WITH INCREASED TOUGHNESS AND METHOD FOR INCREASING THE TOUGHNESS OF SUCH DRILL BITS

TECHNICAL FIELD

The present invention concerns a drill bit for a rock drilling tool. The present invention also concerns a rock drilling tool and a method for treating drill bits for a rock drilling tool.

BACKGROUND OF THE INVENTION

A drilling tool comprising drill bits for rock drilling usually comprises a plurality of drill bits, made out of a hard material, embedded in a drilling head of relatively softer material, such as steel. The drill bits usually have a cylinder-like part that is embedded in the steel and a dome-shaped end profile that projects from the steel.

Such drill bits are usually manufactured from a composite material, constituted by a hard phase and a binder phase. The hard phase is usually tungsten carbide and the binder phase is often cobalt. Lubricant is also used to simplify the shaping of the drill bits. This composite material is compressed into a desired drill bit shape (green body) and is heated (often under controlled pressure and in a gas mixture specially adapted for the process) so that the binder phase becomes more viscous and wets the tungsten carbide particles and the tungsten carbide particles are joined together in this way. Depending on the starting material the drill bits will shrink to the desired final geometry during the cooling stage of the sintering process. They are then ground and cascaded. During the cascading the drill bits are mechanically treated as they rub against one another or against an added abrasive material. Cascading is used to get rid of corners and to round off edges on the drill bits and is considered to be the most economic method for cleaning and surface treating. In cascading, water in combination with an addition of so-called compound is usually used. The compound can be cleaning, de-greasing, pH-regulating, protective against corrosion, lubricating and grinding. In order to hold the components that are being cascaded apart, so called chips can be used. The chips are solid bodies that can have different shapes, such as pyramidal, conical, cylindrical etc.

Certain types of sintered carbide, such as composite material with a hard phase with an average particle size of circa 2.5 micrometers and with circa 6% binder phase, are fine-grained and thereby very hard. Such composite material therefore has such hardness that it is considered to be too hard and brittle to be used when drilling in hard rock, typically quartz rock. In this type of rock a softer composite material is therefore used for the drill bits, for example material having a greater average particle size in the hard phase and/or with a higher binder phase content. In these cases the drill bits unfortunately wear out much more quickly and the drilling tool has a shorter lifetime. Another example of when one has to change to a softer drill bit is when drilling in iron ore.

U.S. Pat. No. 7,258,833 discloses a method that increases the surface toughness and the surface hardness of tungsten carbide components. The authors of the patent claim that the method prevents the formation of cracks and/or the rupture of the components and increases their abrasion resistance. Furthermore, the authors of the patent claim that the method substantially increases the surface hardness of treated components.

SUMMARY OF THE INVENTION

An object of the present invention is to provide an improved drill bit for a rock drilling tool.

This object is achieved with a drill bit according to claim 1, whereby the drill bit has a drilling surface that is arranged to come into contact with the material that is to be drilled. A longitudinal cross section (10*t*) of the drill bit (10) exhibits the following relationship between the total Palmqvist crack length at different depths $L_{tot}$(depth) below the drilling surface and the total Palmqvist crack length at 5.0 mm depth $L_{tot}$(5.0), i.e. $L_{tot}$(depth)/$L_{tot}$(5.0) if the drill bit (10) has a length (L) of 10 mm or greater, whereby a drill bit's length is the greatest distance in a direction that is coaxial or parallel to the drill bit's longitudinal axial centre line (C). The above-mentioned cross section also exhibits the following relationship between the hardness at different depths H(depth) and the hardness at 5.0 mm H(5.0), i.e. H(depth)/H(5.0). The properties are measured substantially along or at a maximum distance of D/4, preferably at a maximum distance of D/6, from the drill bit's longitudinal axial centre line (C) whereby D is the drill bit's diameter, i.e. the greatest distance that is at a right angle in relation to the drill bit's longitudinal axial centre line (C) and that can be measured on the drill bit. The normal to the cross sectional plane shall be at a right angle (orthogonal) or substantially orthogonal to the drill bit's longitudinal axial centre line, see FIG. 1. The drill bit's properties at 5.0 mm depth are considered to be the same as in bulk of the drill bit.

| Depth [mm below the drilling surface (10b)] | $L_{tot}$(depth)/$L_{tot}$(5.0) × 100 | H(depth)/H(5.0) × 100 |
|---|---|---|
| 0.3 | max 40, preferably max 20 | max 104 |
| 0.5 | max 52, preferably max 32 | max 104 |
| 1.0 | max 75, preferably max 56 | max 104 |
| 2.0 | max 94 preferably max 80 | Max 104 |
| 5.0 | 100 | 100 |

A longitudinal cross section (10*t*) of the drill bit (10) through the drilling surface (10*b*) exhibits the following relationships $L_{tot}$(depth)/$L_{tot}$(3.5) and H(depth)/H(3.5) at the specified depths, where H(depth)/H(3.5) is measured according to a Vickers test and $L_{tot}$(depth)/$L_{tot}$(3.5) is measured according to the Palmqvist method described in this document, substantially along the drill bit's longitudinal axial centre line (C):

| depth [mm below the drilling surface (10b)] | $L_{tot}$(depth)/$L_{tot}$(3.5) × 100 | H(depth)/H(3.5) × 100 |
|---|---|---|
| 0.3 | max 40, preferably max 20 | max 104 |
| 0.5 | max 52, preferably max 32 | max 104 |
| 1.0 | max 75, preferably max 56 | max 104 |
| 2.0 | max 94 preferably max 80 | Max 104 |
| 3.5 | 100 | 100 |

if the drill bit (10) has a length (L) of less than 10 mm and whereby the drill bit's properties at a depth of 3.5 mm are considered to be the same as in the bulk of the drill bit. The tables above give the measured values towards the centre of the drill bit i.e. down to 3.5 mm below the drilling surface for drill bits that have a length less than 10 mm, and down 5 to 5.0 mm below the drilling surface for drill bits that have a length of 10 mm or greater.

The Palmqvist crack length is inversely proportional to the drill bit's critical fracture toughness. The shorter the Palmqvist crack length, the tougher the drill bit material. A drill bit that exhibits a Palmqvist crack length and a hardness according to the tables above will therefore get tougher as one approaches the drilling surface, although its hardness will not increase substantially, as one approaches the drilling surface.

Tougher drill bits result in fewer drill bit ruptures and a longer lifetime when drilling. This consequently results in products, such as drill bits, rock drilling tools, bore crowns comprising drill bits and rock drilling machine becoming marketable for drilling in more materials i.e. the number of rock formations for which the drill bits can be used increases. This is particularly applicable for drilling in hard material, such as drilling in quartz rock. Furthermore better properties are obtained when drilling in iron ore for example, where a type of drilling tool with chisel like bits (rotary bit crowns) are often used today instead of drill bits. Such drill bit bore crowns are cheaper to manufacture than rotary bit crowns and have a so high drilling speed (so called drilling rate) that is almost double that of rotary bit crowns.

In the above-mentioned rock formations one can, by using a treatment method according to the present invention, select a harder drill bit that wears out (loses its original shape) more slowly and in this way increase the tool's lifetime.

In order to determine a material's hardness an indentation method, a so called Vickers test (according to standard DIN50133, "Theory and User Information, Volume A, Users Manual 2001") is used. The principle behind a Vickers test is to measure a material's ability to withstand plastic deformation and the measured hardness value is given in units of $N/mm^2$. A pyramid-shaped diamond indenter (see FIG. 3) with a top rake angle of 136° is pressed into a flat test piece, namely a longitudinal cross section of a drill bit, with a predetermined force (F in Newtons). The length of the two diagonals (DIA1 and DIA2) in the indent are measured and the average value ($DIA_{medel}$ in mm) is calculated. The hardness (H) can thereafter be looked up in conversion tables or be calculated using an equation.

During Vickers measurements in hard materials cracks (so called Palmqvist cracks) are formed at the extension of the diagonals, see FIG. 5.

The drill bits' critical fracture toughness is also evaluated from the indentation method using the following equation for Palmqvist cracks, which has been proposed by W. D. Schubert et al in the International Journal of Refractory Metals & Hard Materials 16 (1998) 133-142:

$$K_{1C} = A\sqrt{H} \times \sqrt{\frac{P}{L_{tot}}}$$

where $K_{IC}$ is the critical fracture toughness, H is the hardness in ($N/mm^2$), A is a constant, P is the loading force in (N) and $L_{tot}$ is the total Palmqvist crack length, i.e. the sum (in mm) of the length of the four Palmqvist cracks ($L_1+L_2+L_3+L_4$) (shown in FIG. 5) created by the indenter on measuring hardness (the Palmqvist method). One of the Palmqvist cracks is shown in FIG. 6. For a particular hardness, shorter Palmqvist cracks ($L_{tot}$) give a higher critical fracture toughness ($K_{1C}$) and thereby a tougher material.

According to an embodiment of the invention the drill bit comprises or is constituted of a composite material that comprises a hard phase, such as tungsten carbide, niobium carbide, titanium carbide, tantalum carbide, vanadium carbide, chromium carbide, titanium carbonitride or a mixture or a chemical compound of these materials.

According to another embodiment of the invention the drill bit comprises a hard phase joined with a binder phase of cobalt, nickel, iron (low alloy or just with normal alloying) or a mixture or chemical compound of these elements.

According to another embodiment of the invention the drill bit comprises a composite material with a hard phase having an average particle size of circa 2-3 micrometers and with circa 6% cobalt binder phase.

According to another embodiment of the invention the drill bit comprises a binder phase of cobalt, nickel, iron or a mixture or chemical compound of these elements, of 4-12%.

According to another embodiment of the invention the hard phase in the sintered carbide drill bit has an average particle size of up to 10 micrometers, preferably between 0.5 to 5.0 micrometers and more preferably from 1.5 to 3.5 micrometers, whereby the average particle size is determined by microscopic evaluation of a cross section of the finished product, for example in accordance with ASTM standard E112-96 (Reapproved 2004) "Standard Test Methods for Determining Average Grain Size".

According to a further embodiment of the invention the drill bit has an end that is dome-shaped, semi-ballistic, semi-spherical, semi-cylindrical or of any other desired shape, whose outer edge defines the drilling surface.

According to an embodiment of the invention the drill bit has a length of 10 mm or greater and a diameter (D) of at least 7 mm, preferably between 7-22 mm. Alternatively the drill bit has a length of less than 10 mm and a diameter (D) of at least 7 mm, preferably between 7-22 mm.

According to an embodiment of the invention the drill bit comprises a cylindrical part with a diameter (D) of 7 mm or greater. According to another embodiment of the invention the drill bit has a mass of 5 grams or greater. Preferably the drill bit has a diameter (D) between 7-22 mm and a mass of between 5-150 grams.

The present invention also concerns a treatment method for increasing the toughness of drill bits for a rock drilling tool without substantially increasing the hardness of said drill bits. Experiments have shown that this is achieved by colliding drill bits manufactured of tungsten carbide with 6% cobalt with an average particle size of 2.5 micrometers with one another. These drill bits exhibit properties according to the table on page 3. These properties are specified in claim 1. If the energy on collision is low, less than 35 mJ the drill bits are marginally affected i.e. only a marginal reduction of the total Palmqvist crack length ($L_{tot}$) as a function of depth, is achieved. If the collision energy becomes too high, over 175 mJ, both an increased hardness in the surface region and an increased toughness is obtained. Collisions in the energy range 35-175 mJ, preferably 35-100 mJ provide drill bits with increased critical fracture toughness and marginally increased or maintained hardness.

The total energy (E) before drill bits collide is calculated using one of the following equations, (see FIG. 9):

$$E=mgh \text{ or } E=mv^2/2$$

Where m is the drill bit's mass (in kg), g is the acceleration of gravity 9.81 $m/s^2$, h is the drop height and v is the drill bit's speed (in m/s) before it collides with/is pressed against another drill bit during the treatment method.

The treatment method can be automated in a number of different ways for example using a conveyor belt that transports drill bits up to a certain height in order to then let them fall onto a bed of drill bits, by rotating a drum at a rotational speed that allows drill bits to drop a height that results in the right treatment energy, by subjecting drill bits to vibration cascading or centrifugal cascading so that they attain the right treatment energy.

Three examples of how the product properties that are mentioned in claim 1 can be obtained are provided below.

i) Rotation Cascading

A rotating drum (with a horizontal axis); cylindrical or polygonal, is filled to 1-75%, preferably 15-50% with components that are to be treated. The drum's diameter and rotational speed is of great importance to the process, while its length is of less importance. Before the start of the process the components are loaded into the drum together with water and an additive, such as cleaning compound and/or pH-adjusting means, pure water alone can also be used, as well as just air. No abrasive (grinding) medium is added.

In the process the drum is brought to rotate so that the components that are in the drum follow the rotation of the outer wall up to a certain point, at which point they move away from the outer wall and are projected firstly upwards and then downwards into a bed of other components. The rotational speed and the drum's diameter in combination with the extent to which the drum is filled determines the height h in the equation E=mgh, described above. The individual mass of the components, the drum's diameter and the extent to which the drum is filled is known and the rotational speed is therefore calculated so that the desired drop height h is achieved. In this way an energy level can be determined for a arbitrary collision between components. Time then determines how many of these collisions take place. The process time is usually between 0.5-16 hours or more, preferably 1.5-6 hours.

There now follow some rotational speeds and drum diameters that result in products having the properties that are mentioned in claim 1.

Ø=190 mm and 20-100 rpm. This gives drop heights of 80-120 mm and a kinetic energy prior to collision of circa 35-120 mJ for drill bit masses in the range of 47-150 grams.

Ø=300 mm and 15-75 rpm. This gives drop heights of 125-190 mm and a kinetic energy prior to collision of circa 40-135 mJ for drill bit masses in the range of 20-110 grams.

Ø=600 mm and 10-55 rpm. This gives drop heights of 250-380 mm and a kinetic energy prior to collision of circa 35-150 mJ for drill bit masses in the range of 10-40 grams.

Drill bits according to the present invention have been provided by using a rotational cascading machine under the following conditions:

Diameter=190 mm, the extent to which the drum is filled=33%, rotational speed=75 rpm, drill bit mass=74.8 g and treatment time=2 hours. See the results regarding toughnesss and hardnesss properties in FIG. 7 and FIG. 8 (the curves labelled "rotation"). The drum is internally provided with four transverse wings that are 5 mm high.

It should be mentioned that when rotation cascading, a lateral speed ($v_x$, FIG. 9) occurs due to the rotational speed but within the given rotational speeds and drop heights its contribution to the kinetic energy prior to a collision is lower than 10%.

Drill bits according to the present invention with a diameter of 14.5 mm and 15.8 mm or a mass of 48 or 63 grams respectively have been provided by using such a rotational cascading machine with a drum having a diameter of 190 mm (and with internal wings of 5 mm) under the following conditions:

- 44 RPM, the extent to which the drum is filled 30%, drill bit mass 62.8 g, cascading time 8 hours, corresponds to a collision energy of 54 mJ
- 44 RPM, the extent to which the drum is filled is filled 30%, drill bit mass 47.8 g, cascading time 16 hours, corresponds to a collision energy of 45 mJ
- 44 RPM, the extent to which the drum is filled 50%, drill bit mass 62.6 g, cascading time 12 hours, corresponds to a collision energy of 60 mJ
- 44 RPM, the extent to which the drum is filled 30%, drill bit mass 62.8 g, cascading time 12 hours, corresponds to a collision energy of 54 mJ
- 44 RPM, the extent to which the drum is filled 30%, drill bit mass 62.8 g, cascading time 16 hours. Corresponds to a collision energy of 54 mJ
- 75 RPM, the extent to which the drum is filled 33%, drill bit mass 47.8 g, cascading time 2 hours. Corresponds to a collision energy of 57 mJ
- 75 RPM, the extent to which the drum is filled 33%, drill bit mass 47.8 g, cascading time 4 hours. Corresponds to a collision energy of 57 mJ ii) Vibration Cascading Vibration cascading is a process in which components that are to be treated are loaded into a spring-suspended vessel. An electric motor, that is centrally mounted together with the vessel, rotates at a determined speed, which is called frequency here. The electric motor has a weight that is unsymmetrically mounted on its axis, which leads to an imbalance that creates a vibration movement in the vessel where the treatment of components is taking place.

The components are treated by thrusting them against one another and the desired energy is achieved. If the mass of the components is too low (<30 g for drill bits) they have to be mixed with heavier components (so called dummies), so that the right energy level will be achieved in the collisions. When treating components having a large mass, it can on the contrary be advantageous to mix them with small "dummies" in order to reduce the energy and prevent edge damage in the components. Suitably, said "dummies" should be manufactured from the same composite material as the treated components.

A typical vibration cascading machine is loaded with components via the loading lid in the upper part of the machine. Typically, the loading weight is 20-50 kg (i.e. the total weight of drill bits). After loading, water and an additive, such as cleaning compound and/or pH-adjusting means are added, pure water alone may also be used. No abrasive (grinding) medium is added. Using just air as the medium is also possible.

The machine has a control system that is completely automatic, which means that: one selects a program and starts the machine. The power and the treatment time are programmed using respective programs. When the treatment is completed, a rinse program and thereafter a drying program are started.

Drill bits according to the present invention have been provided by using a vibration cascading machine (Reni Cirillo) under the following conditions:

The vessel's volume 25 liters

Motor power 0.75 kW

Frequency 30 Hz (set power=100%)

- 10-drill bits having a mass of 10 g mixed with 418 drill bits having a mass of 47.6 g, i.e. a loading weight of 20 kg (i.e. the total weight of drill bits), cascading time 4 hours.

See the results, regarding toughnesss and hardnesss properties in FIG. 7 and FIG. 8 (the curves labelled "vibration").

iii) Centrifuge

In this process components are loaded from above, down into a vertical drum with a rotating bottom plate. When the bottom plate is brought to rotate, components are slung towards the periphery of the drum and are pressed against the inner wall of the drum. During the coarse of treatment the components are pressed outwards radially around the drum's wall and it is possible to see the bottom of the drum in the centre. The drum's rotating bottom is designed so that the mass pressed to the side moves, due to the high rotational speed, upwards along the inner wall of the drum. Using the right volume of components in the drum creates a warping movement whereby the components that are highest are pressed aside from below and fall down towards the centre. The components rotate around the drum with high rotational speed at the same time as they twist/warp and change position with one another continually.

During the process liquid is added continually, usually water and an additive (compound), such as cleaning compound and/or pH-adjusting means, pure water alone can also be used. No abrasive (grinding) medium is added. The liquid is pressed out through the column located between the drum's wall and the rotating bottom plate. Using just air as the medium is also possible.

In this process energy is provided by the high rotational speed which results in a large part of the loaded volume acting as pressing mass on a small part of the loaded volume, namely the components that are located outermost against the drum's inner wall are subjected to the greatest pressure loading. Due to the warping movement a continual mixing is achieved, which results in all of the components being equally treated by one another.

Drill bits according to the present invention have been provided by using a centrifuge (ERBA TURBO-60) under the following conditions:

Volume: 60 liters, Ø=500 mm, height=360 mm

Rotational speed: 250 rpm.

Drill bit mass=11.3 g, total mass=100 kg, which gives a volume of circa 10 liters, treatment time 3 hours.

See the results, regarding toughnesss and hardnesss properties in FIG. 7 and FIG. 8 (the curves labelled "centrifugal").

The above-mentioned examples show how standard machines intended for a certain purpose can be used for another purpose. There are many different manufacturers of the respective machines and there are also other types of machines and methods that may be used in order to obtain the desired energy level according to the present invention.

Experiments have shown that an en energy (E) of 35-175 mJ is necessary in order for drill bits manufactured from tungsten carbide with 6% cobalt with an average particle size of 2.5 μm to exhibit the desired properties according to the table on page 3. These properties are specified in claim 1.

It should be noted that the equations for calculating said energy (E) are much more complex that which has been given above and that the above-mentioned way of calculating the energy is very simplified because it does not consider factors such as media and friction among other things.

Even though the equation is simplified, this invention is based on the insight that conventional machines can be used in order to increase the toughness of drill bits for a rock drilling machine without substantially increasing the hardness of said drill bits, if these machines are operated in a certain way, namely if the total energy (E) arising prior to drill bits colliding lies between 35-175 mJ. It is known that said energy (E) is a function of a machine's diameter, rotational speed, mass and the extent to which the drum is filled. A skilled person can therefore determine how a certain machine shall be operated in order to provide drill bits according to the present invention either by calculation or by carrying out experiments or following the examples given in the present invention.

According to an embodiment of the invention the fragments that come from drill bits during the treatment are removed, either continually or periodically. This means that drill bit fragments can not damage the drill bits during the cascading. Drill bit fragments can be removed by draining treatment liquid from the machine and in this way the drill bit fragments are transported away with the water. Furthermore, the drill bits can be rinsed, for example during a vibration cascading step, in order to transport drill bit fragments away. Alternatively, drill bit fragments can be removed by constant filtering of the process water, magnetic removal or by using a sieve trap.

According to an embodiment of the invention the treatment energy is increased by increasing the treatment speed during the treatment method, either continually or in a stepwise manner. Low toughness results more brittle drill bits. Since drill bits become tougher during the treatment, they withstand being subjected to more powerful treatment and the treatment speed/energy can thereby be increased during the method.

According to another embodiment of the invention the hardness, that is measured at up to 3.5 mm below the drilling surface for drill bits that have a length of less than 10 mm and at up to 5.0 mm below the drilling surface for drill bits that have a length of 10 mm or greater, becomes max 4% higher than the hardness that is measured in the bulk of the drill bit.

Further embodiments of the method according to the invention are given in the dependent method claims.

Drill bits can of course be ground to a predetermined size before and/or after they have been subjected to a method according to the present invention.

The present invention further concerns a rock drilling tool that comprises at least one drill bit according to an embodiment of the invention. The rock drilling tool is particularly, although not exclusively intended for drilling in ore or in hard material such as quartz rock.

BRIEF DESCRIPTION OF THE DRAWINGS

In the following, the present invention will be described in more detail with reference to the accompanying schematic drawings in which.

$L_{tot}(5.0))\times100$, for three different treatment methods, rotation cascading, vibration cascading and centrifugal cascading according to the parameters in the present invention.

Figure 8:
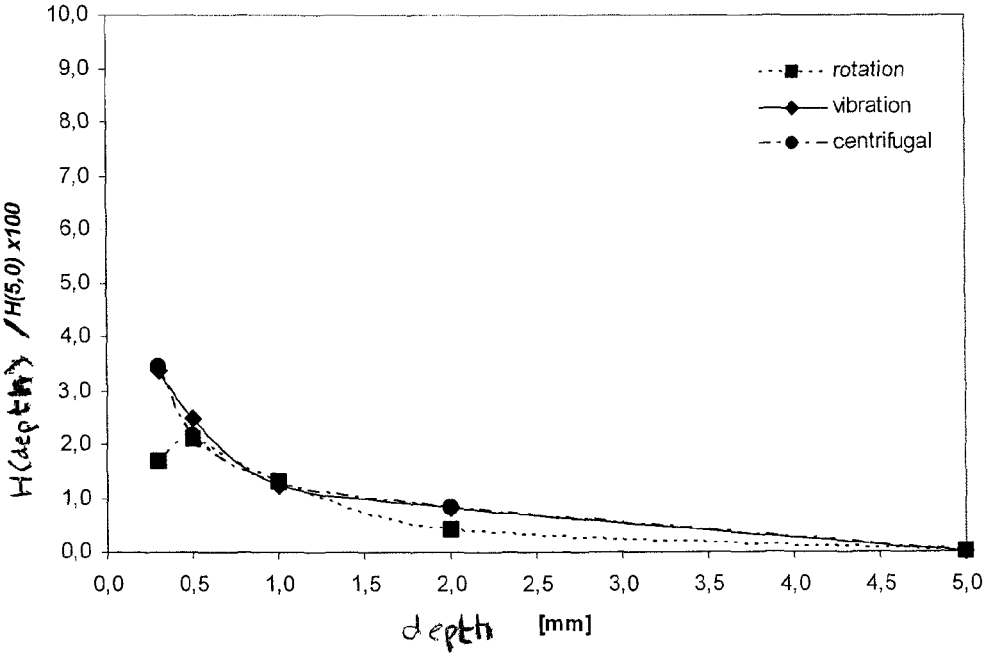

FIG. 8 shows the percentage relationship between hardness at different depths (H(depth)) and the hardness at 5.0 mm H(5.0), i.e. (H(depth)/H(5.0))×100, for three different treatment methods, rotation cascading, vibration cascading and centrifugal cascading according to parameters in the present invention.

Figure 9:
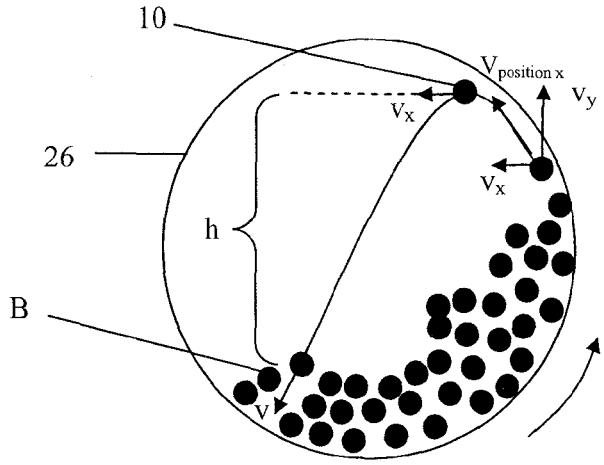

FIG. 9 shows the drop height h and the speed v prior to a collision and thereby how the energy is calculated for a rotational cascading machine.

Figure 10:
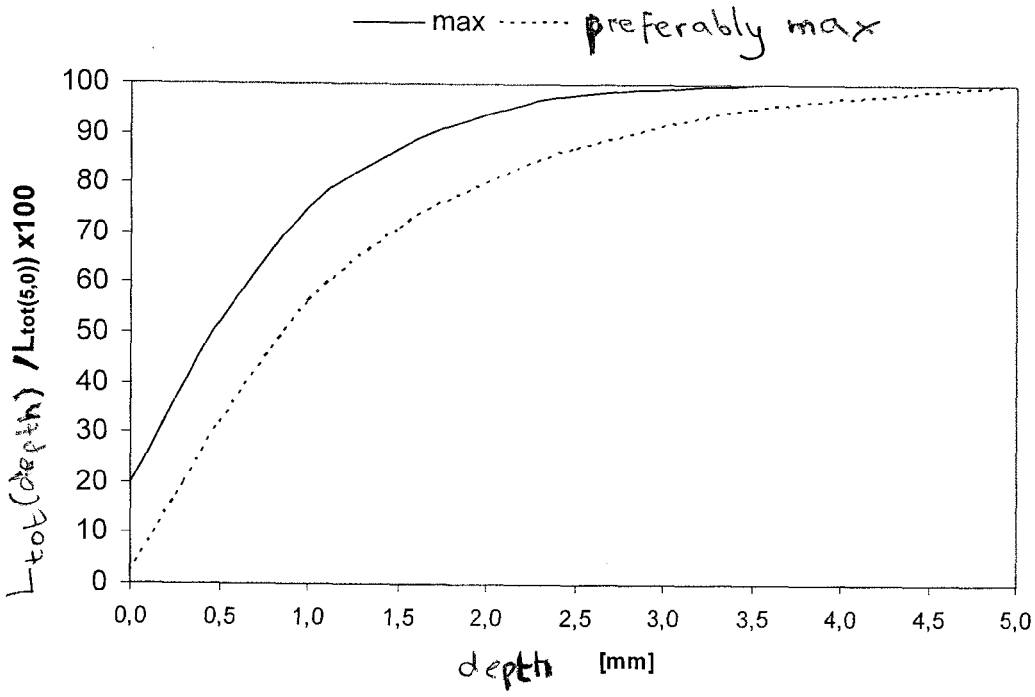

FIG. 10 shows the percentage relationship ($L_{tot}$(depth)/$L_{tot}$(5.0)×100) that drill bits manufactured by the present invention exhibit.

It should be noted that the drawings are not necessarily drawn to scale and that the dimensions of certain features may have been exaggerated for the sake of clarity.

DETAILED DESCRIPTION OF EMBODIMENTS

Figure 1:
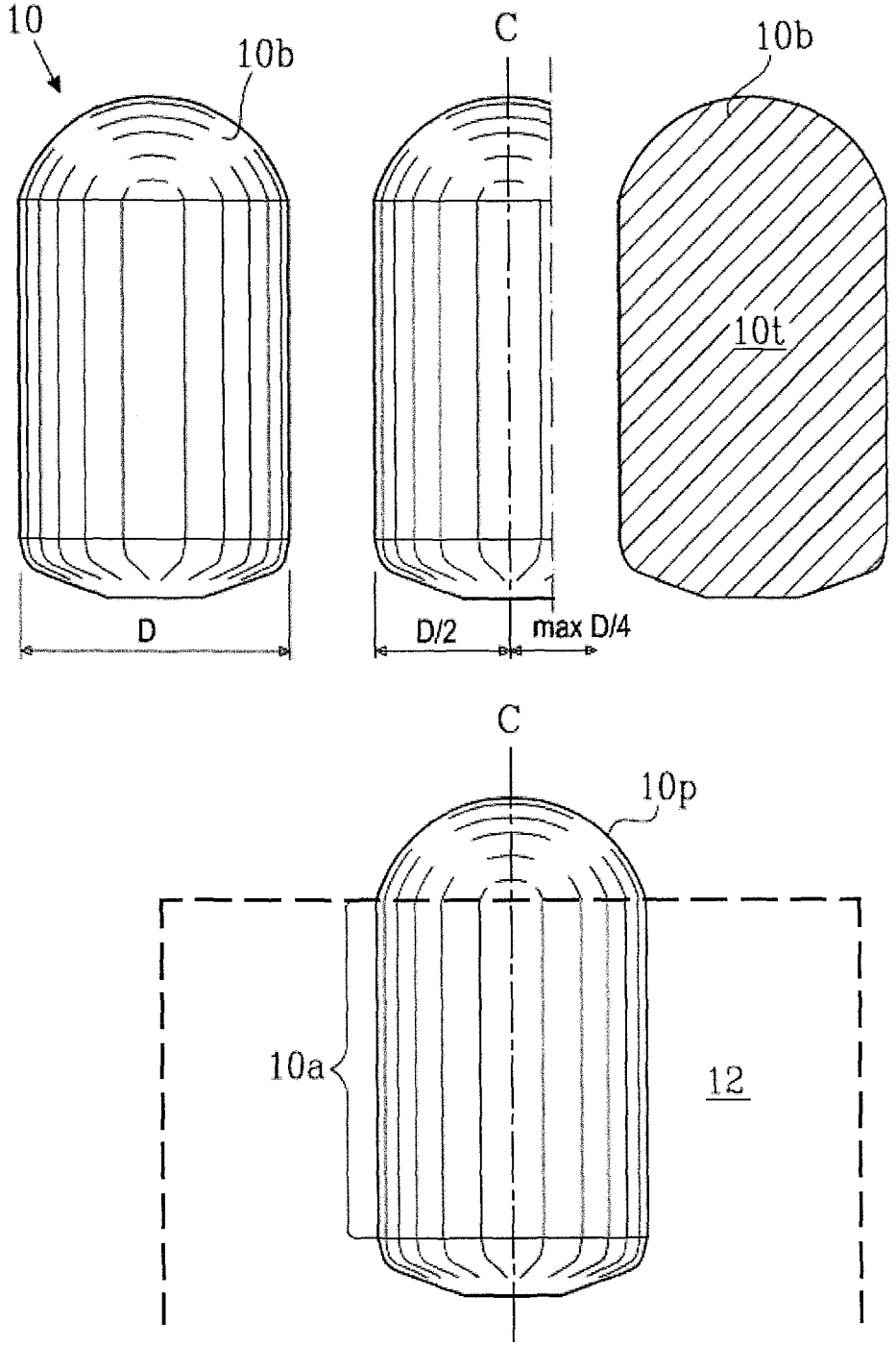
FIG. 1 shows a drill bit according to an embodiment of the invention and a longitudinal cross section.

FIG. 1 shows a drill bit 10 embedded in a drill head of a rock drilling tool 12. Drill bits 10 have a cylinder-like part 10*a* with a diameter D of, for example, 16 mm, and a dome-like end profile 10*p* projecting from the drill head whose outer edge defines a drilling surface 10*b*. The end profile 10*p* can however be semi-ballistic, semi-spherical, semi-cylindrical or of some other desired shape.

According to an embodiment of the invention the drill bit 10 has a diameter (D) of 7 mm or greater, or a mass of 5 grams or greater and it comprises sintered carbide, with tungsten carbide grains with an average particle size of 2.5 micrometers and 6% binder phase of cobalt or tungsten carbide grains joined with a binder phase of 3-12% cobalt, preferably 6-2.5% cobalt with an average particle size of up to 10 micrometers, preferably between 0.5 to 5.0 micrometers and more preferably from 1.5 to 3.5 micrometers.

$L_{tot}$(depth) and H(depth) have been measured at different depths, substantially along the drill bit's axial centre line (C) of the longitudinal cross section (10*t*), i.e. at a maximum distance of D/4 from the drill bit's longitudinal axial centre line (C), see FIG. 1. For example, if a drill bit has a diameter of 16 mm the Palmqvist cracks and the hardness are measured on a longitudinal cross section that is displaced a maximum of 2.0 mm, from another longitudinal plane containing the drill bit's longitudinal axial centre line (C). The cross sectional plane's normal should be at right angles (orthogonal) or substantially orthogonal to the drill bit's longitudinal axial centre line.

Figure 2:
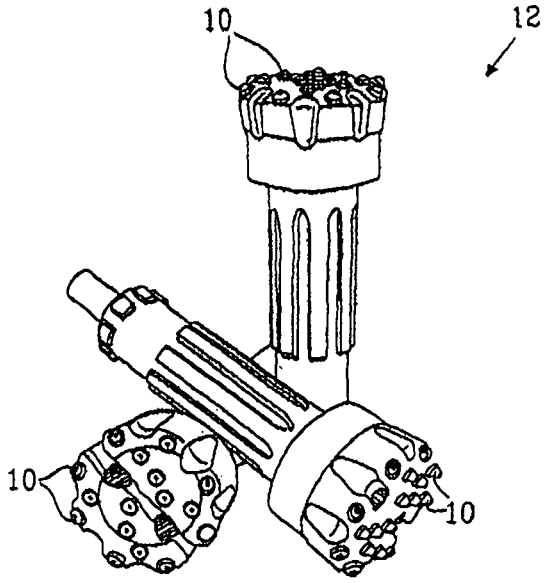
FIG. 2 shows some typical rock drilling tools, sinker drill crowns, where the present invention can be applied.

FIG. 2 shows some typical rock drilling tools 12, namely sinker drill crowns, where drill bits 10 according to the present invention can be applied.

Figure 3:
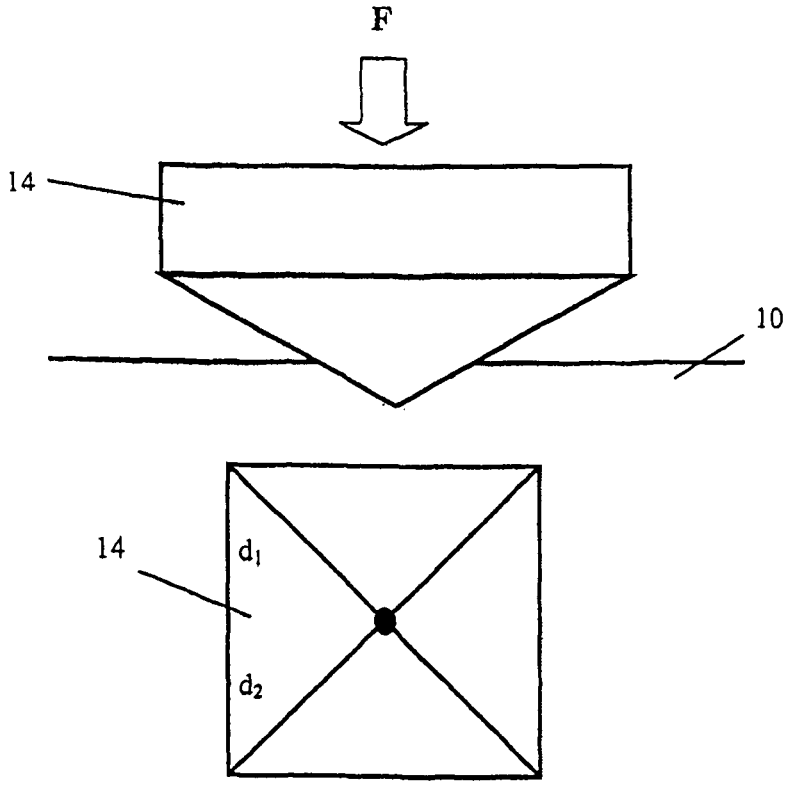
FIG. 3 shows an indenter that is used in an indentation method.

FIG. 3 shows a pyramid-shaped diamond indenter 14 from the side and from below, which diamond indenter 14 is used in a Vickers test to measure hardness. A series of Vickers indents are made in accordance with the pattern in FIG. 4 by loading a Vickers pyramid-shaped diamond indenter 14, having diagonals $d_1$ and $d_2$ and a top rake angle of 136°, with 30 kg (HV30) (F=300N). The indenter 14 is pressed into the drill bit's cross section from above with a penetration speed for example between 0.001 to 0.02 mm/s for 30 seconds at certain determined depths below the drill bit's drilling surface 10*b*. The indenter 14 is subsequently removed, and depending on the material's hardness a pyramid-shaped indent will be formed on the test surface with diagonals DIA1 and DIA2. The two diagonals in the indent are measured and the average value ((DIA+DIA2)/2) in mm is calculated, whereby the drill bit's hardness (H) can then be calculated or looked up in conversion tables. In order to prepare a drill bit 10 for measurement, the drill bit is cast in resin and polished so that a longitudinal cross section is created. The drill bit is coarsely ground down so that a maximum distance of D/4 remains to the drill bit's longitudinal axial centre line (C). The created cross section surface (10*t*) is then polished in batches with finer and finer grinding media, so that it becomes free from scratches. In the final grinding phase a 3 micrometer diamond suspension is usually used in order to reduce any remaining residual stress.

Figure 4:
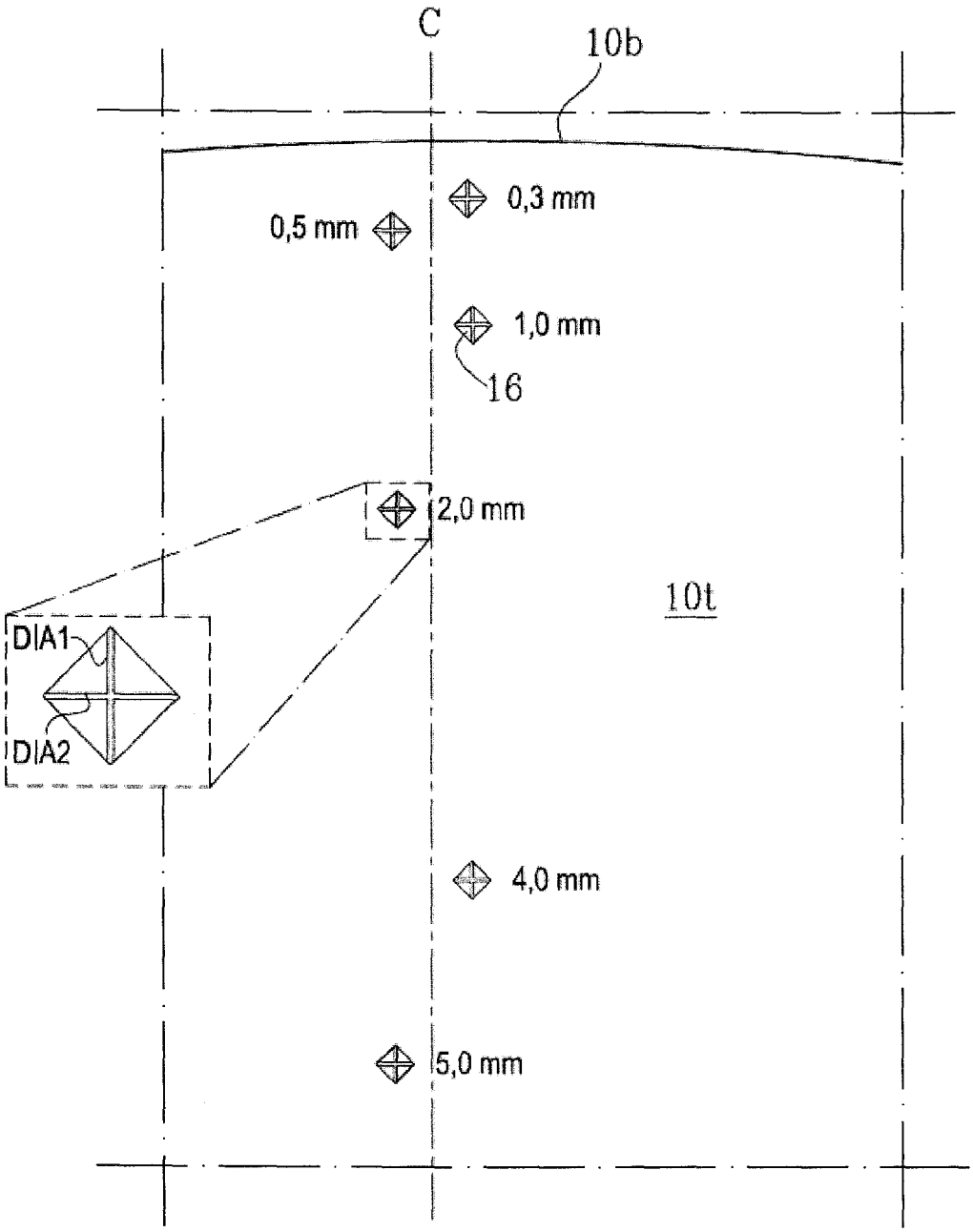
FIG. 4 shows the indents that are made in a polished longitudinal cross section of the drill bit material: the indent's distance from the drilling surface is given in mm where DIA1 and DIA2 in the various indents are used to determine the material's hardness.
Figure 5:
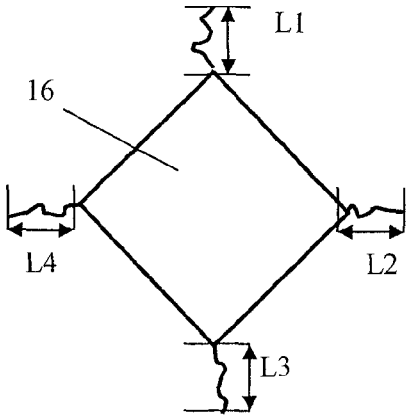
FIG. 5 shows a diagram of Palmqvist cracks $L_1$, $L_2$, $L_3$ and $L_4$ at the four different corners of the indent.

FIG. 4 shows the indents (16) that are left in the drill bit's cross section (10*t*) made parallel to the drill bit's longitudinal axial centre line (C). Due to the drill bit's brittleness, so called Palmqvist cracks (18) are formed at the ends of the indent (16). A hardness value H(depth) can be calculated and $L_{tot}$(depth) can be calculated from each indent (16), which makes it possible to compare differences in the drill bit's toughness and hardness at each measurement point, i.e. at a depth of 0.3, 0.5, 1.0, 2.0 and 5.0 mm below the drilling surface (10*b*). A first indent is also made at 4.0 mm below the drilling surface (10*b*) in order to minimize errors on measuring.

Figure 6:
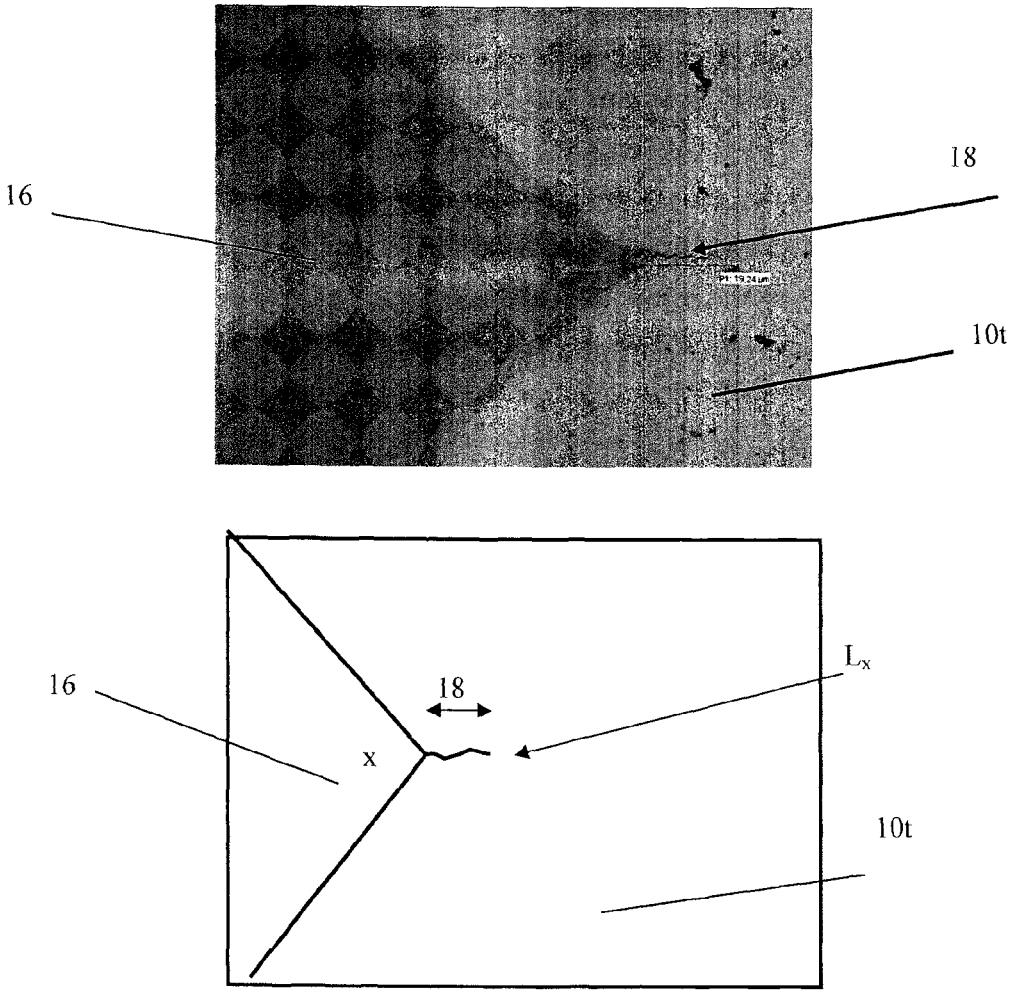
FIG. 6 shows a diagram of a Palmqvist crack, $L_x$, where x represents the four different corners of the indent and $L_x$ represents the individual Palmqvist cracks $L_1$, $L_2$, $L_3$ and $L_4$.

FIG. 6 shows a diagram of a Palmqvist crack (18) in the drill bit's cross section (10*t*) as it looks under an optical microscope with a magnification of 500×. The total Palmqvist crack length $L_{tot}$(depth) is measured from the corner of the indent (16) in a direction that coincides with the indent diagonal. The Palmqvist crack length $L_{tot}$(depth) gives an indication of a drill bits critical fracture toughness, the shorter $L_{tot}$(depth) and thereby the lower $L_{tot}$(depth)/$L_{tot}$(5.0), the tougher the drill bit. It should be noted that the total Palmqvist crack length that is recited in claim 1 concerns the sum of all four Palmqvist cracks i.e. ($L_{tot}$=

Figure 7:
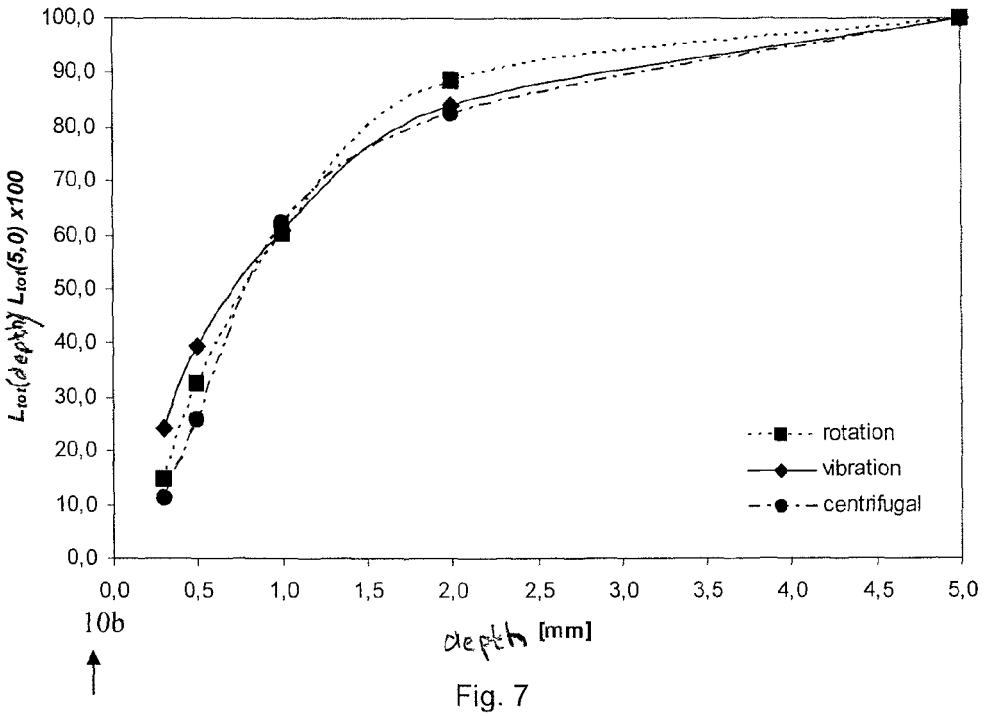
FIG. 7 shows the relationship between the total Palmqvist crack length at different depths $L_{tot}$(depth) and the total Palmqvist crack length at 5.0 mm depth $L_{tot}$(5.0) i.e. ($L_{tot}$(depth)/

FIG. 7 shows the results of measurements of the total Palmqvist crack length $L_{tot}$(depth) for three different treatment methods, rotation cascading, vibration cascading and centrifugal cascading according to parameters in the present invention. FIG. 7 shows how the ratio ($L_{tot}$(depth)/$L_{tot}$(5.0)×100) varies with depth below the drilling surface 10*b*, (i.e. 0.0 mm below the drilling surface), whereby $L_{tot}$(depth) is given as a % of $L_{tot}$(5.0) i.e. the total Palmqvist crack length measured at 5.0 mm depth and whereby a drill bit's properties at 5.0 mm depth is considered to be the same as in the bulk of the drill bit. FIG. 7 shows that drill bits become tougher as one approaches the drilling surface 10*b*.

FIG. 8 shows the difference in a drill bit's hardness as a function of depth from the surface, in relation to its bulk, for three different treatment methods, rotation cascading, vibration cascading and centrifugal cascading according to parameters in the present invention. FIG. 8 shows how the relationship H(depth)/H(5.0) varies at different depths below the drilling surface 10*b*, (i.e. 0.0 mm below), whereby H(depth) is given in % of H(5.0) and whereby a drill bits properties at 5.0 mm depth are considered to be the same as in the bulk of the drill bit. FIG. 8 shows that the drill bit's hardness does not become substantially higher as one approaches the drilling surface (10*b*).

FIG. 9 shows how the total energy E arising prior to drill bits (10) colliding in a rotational cascading machine (26) is calculated. Since the energy contribution from $v_x$=the speed in the x-direction, in the example is less than 10% of the total collision energy and negligible, the total energy E is principally equal to a drill bit's potential energy (mgh). Where m is the mass of a drill bit (10) (in kg), g s the acceleration of gravity (9.81 m/s$^2$) and h is the height at the highest point before the drill bit (10) turns downwards and falls down into the bed (B) where it lands (in m).

FIG. 10 shows how $L_{tot}$(depth)/$L_{tot}$(5.0) varies at different depths(d) below the drilling surface (10*b*), see the indent profile in FIG. 4, the properties at 5.0 mm depth are considered to be the same as in the bulk of the drill bit. The two lines in FIG. 10 define the present invention's maximum ($L_{tot}$(depth)/$L_{tot}$(5.0)×100) and preferably the maximum ($L_{tot}$(depth)/$L_{tot}$(5.0)×100). FIG. 10 namely shows that drill bits become tougher as one approaches the drilling surface (10*b*). The two lines max and preferably max, are based on a plurality of measured drill bits that have been manufactured in accordance with methods according to the present invention.

Several modifications of the invention would be apparent to a skilled person. For example, even though the claims are directed to a drill bit for a rock drilling tool, a method according to the present invention could be used in order to increase toughness of a different component for a rock drilling machine without substantially increasing its hardness.

The invention claimed is:

1. A drill bit (10) for a rock drilling tool (12), which drill bit (10) has a drilling surface (10*b*) that is arranged to contact rock during drilling, wherein a longitudinal cross section (10*t*) of the drill bit (10) through the drilling surface (10*b*) exhibits the following relationships of $L_{tot}$(depth)/$L_{tot}$(5.0) and H(depth)/H(5.0) at the specified depths, where H(depth)/H(5.0) is measured according to a Vickers test and $L_{tot}$(depth)/$L_{tot}$(5.0) is measured according to the Palmqvist method described in this document substantially along the drill bit's longitudinal axial centre line (C):

| depth [mm below the drilling surface (10b)] | $L_{tot}$(depth)/$L_{tot}$(5.0) × 100 | H(depth)/H(5.0) × 100 |
|---|---|---|
| 0.3 | max 40, preferably max 20 | max 104 |
| 0.5 | max 52, preferably max 32 | max 104 |
| 1.0 | max 75, preferably max 56 | max 104 |
| 2.0 | max 94, preferably max 80 | Max 104 |
| 5.0 | 100 | 100 |

if the drill bit (10) has a length (L) of 10 mm or greater; and a longitudinal cross section (10*t*) of the drill bit (10) through the drilling surface (10*b*) exhibits the following relationships of $L_{tot}$(depth)/$L_{tot}$(3.5) and H(depth)/H(3.5) at the specified depths, where H(depth)/H(3.5) is measured according to a Vickers test and $L_{tot}$(depth)/$L_{tot}$(3.5) is measured according to the Palmqvist method described in this document, substantially along the drill bit's longitudinal axial centre line (C):

| depth [mm below the drilling surface (10b)] | $L_{tot}$(depth)/$L_{tot}$(3.5) × 100 | H(depth)/H(3.5) × 100 |
|---|---|---|
| 0.3 | max 40, preferably max 20 | max 104 |
| 0.5 | max 52, preferably max 32 | max 104 |
| 1.0 | max 75, preferably max 56 | max 104 |
| 2.0 | max 94, preferably max 80 | Max 104 |
| 3.5 | 100 | 100 |

if the drill bit (10) has a length (L) less than 10 mm, wherein the drill bit is modified to achieve the aforementioned values subsequent to a sintering process.

2. Drill bit (10) according to claim 1, wherein said drill bit comprises a composite material that comprises a hard phase, such as tungsten carbide, niobium carbide, titanium carbide, tantalum carbide, vanadium carbide, chromium carbide, titanium carbonitride or a mixture of these materials.

3. Drill bit (10) according to claim 1, wherein said drill bit comprises a hard phase joined with a binder phase of cobalt, nickel, iron or a mixture or chemical compound of these elements.

4. Drill bit (10) according to claim 1, wherein said drill bit comprises composite material with a hard phase with an average particle size of circa 2-5 micrometers and with circa 6% binder phase.

5. Drill bit (10) according to claim 1, wherein said drill bit has an average particle size of up to 10 micrometers, preferably between 0.5 to 5.0 micrometers and more preferably from 1.5 to 3.5 micrometers.

6. Drill bit (10) according to claim 1, wherein said drill bit comprises a binder phase of cobalt, nickel, iron or a mixture or chemical compound of these elements, of 4-12%.

7. Drill bit (10) according to claim 1, wherein said drill bit exhibits an end that is dome-shaped, semi-ballistic, semi-spherical or semi-cylindrical, whose outer edge defines said drilling surface (10*b*).

8. Drill bit (10) according to claim 1, wherein said drill bit has a diameter (D) of at least 7 mm, preferably between 7-22 mm.

9. Drill bit (10) according to claim 1, wherein said drill bit comprises a cylindrical part (10*a*) with a diameter (D) of 7 mm or greater.

10. Drill bit (10) according to claim 1, wherein said drill bit has a mass of 5 grams or greater.

11. Rock drilling tool (12), wherein said drill bit comprises at least one drill bit (10) according to claim 1.

12. Use of a rock drilling tool that comprises at least one drill bit (10) according to claim 1 for drilling in hard rock, including quartz rock, ore or granite.

13. Drill bit (10) according to claim 2, wherein said drill bit comprises a hard phase joined with a binder phase of cobalt, nickel, iron or a mixture or chemical compound of these elements.

14. Drill bit (10) according to claim 2, wherein said drill bit comprises a binder phase of cobalt, nickel, iron or a mixture or chemical compound of these elements, of 4-12%.

15. Drill bit (10) according to claim 5, wherein said drill bit comprises a binder phase of cobalt, nickel, iron or a mixture or chemical compound of these elements, of 4-12%.

* * * * *